United States Patent [19]

Smith

[11] Patent Number: 5,002,198

[45] Date of Patent: Mar. 26, 1991

[54] TAMPER EVIDENT CLOSURE FOR CONTAINER

[75] Inventor: Ernest L. Smith, Kansas City, Mo.

[73] Assignee: Sealright Co., Inc., Kansas City, Mo.

[21] Appl. No.: 398,495

[22] Filed: Aug. 25, 1989

[51] Int. Cl.[5] ..... B65D 17/40

[52] U.S. Cl. ..... 220/276; 220/270; 220/306

[58] Field of Search ..... 220/276, 270, 306; 215/256, 350, 252, 254

[56] References Cited

U.S. PATENT DOCUMENTS

| | | | |
|---|---|---|---|
| 3,414,183 | 12/1968 | Wilcox | 215/321 X |
| 3,805,993 | 4/1974 | Enzie et al. | 220/276 X |
| 4,476,993 | 10/1984 | Krout | 220/276 |
| 4,493,432 | 1/1985 | Smith | 220/270 |
| 4,782,968 | 11/1988 | Hayes | 215/276 |
| 4,798,301 | 1/1989 | Bullock et al. | 215/256 |

*Primary Examiner*—Stephen Marcus

*Assistant Examiner*—Nova Stucker

*Attorney, Agent, or Firm*—Kokjer, Kircher, Bradley, Wharton, Bowman & Johnson

[57] ABSTRACT

A tamper evident container assembly for packaging of dairy and other food products. A container is provided with a closure comprising an end board, a downwardly extending peripheral skirt along an edge of the end board and an upturned locking ring projecting inwardly from a bottom edge of the skirt. The locking ring engages the container rim and prevents removal of the closure while the locking ring is in place. The skirt and locking ring are integrally molded with the end board being attached to the skirt subsequent to the molding process. The locking ring and a portion of the skirt may be severed from the remainder of the skirt along a score line to permit removal of the closure after initial application to the container. Removal of the locking ring provides a visual indication of possible product tampering.

18 Claims, 2 Drawing Sheets

TAMPER EVIDENT CLOSURE FOR CONTAINER

This invention relates in general to the packaging of foods and more particularly to a food container and closure which provide a visual indication of unauthorized opening and other tampering. This invention also relates to a method of forming a tamper evident food package.

Dairy products such as ice cream are often packaged in cylindrical paperboard containers or other relatively inexpensive containers. Access to the container contents is provided by a removable lid which fits tightly against the rim of the container to hold the lid in place and seal the container contents. The lid conventionally comprises spiral wound paper formed into a discoidal end board with a peripheral downturned skirt. The paperboard construction is generally preferred because it is relatively inexpensive yet provides an excellent surface for printing of product information and other high resolution graphics.

Because the lid may be easily removed and replaced, food containers of this type are susceptible to tampering of the container contents in a manner which is not readily detectable. An exemplary attempt to provide visual evidence of initial removal of the lid is provided in my previous U.S. Pat. No. 4,493,432, wherein the tamper evident closure is provided with a locking ring formed by turning a lower portion of the lid skirt inwardly along a circumferential score line. While this arrangement provides an effective and inexpensive mechanism for providing visual evidence of product tampering, there are limits to the interlocking strength that a locking ring formed from paper provides. The closure must therefore be molded from thermoplastic material which has the disadvantage of not providing the high resolution printing surface of paperboard. In addition, the skirt covers the locking ring and, without close inspection of the container, makes it difficult to determine whether the locking ring is in place.

SUMMARY OF THE INVENTION

It is an object of this invention to provide a more secure container closure which cannot be removed while a tamper evident mechanism is in place so that attempted removal of the closure provides visual evidence of possible tampering with the contents of the container.

It is also an object of this invention to provide a container closure having a tamper evident mechanism of improved strength but which is constructed in a manner to permit utilization of conventional molding techniques so that the closure may be manufactured at a low cost suitable for disposable containers.

It is a further object of this invention to provide a low cost disposable container closure having a high strength molded tamper evident mechanism and a paperboard or like end board so that high resolution graphics may be printed on the container closure.

It is yet another object of this invention to provide a method for manufacturing a molded tamper evident container closure in a manner which permits the closure to be molded with a large locking mechanism while still allowing removal of the formed closure from the mold so that conventional molding techniques may be utilized.

To accomplish these and other related objects of the invention, a tamper evident closure lid is provided for a container having a sidewall which terminates in an outwardly extending top rim. The closure lid comprises a skirt which extends downwardly along a peripheral edge of a discoidal end board. A locking ring extends inwardly and upwardly from a bottom edge of the skirt to engage the container rim to prevent removal of the closure lid while the locking ring is in place. A score line separates the skirt into upper and lower segments and provides a weakened line of detachment to enable removal of the locking ring and the lower segment of the skirt when initial removal of the closure lid is desired.

The invention also encompasses a method of manufacturing the closure lid. The locking ring and the skirt are preferably integrally molded with the score line formed either during or after the molding process. The end board is formed from paper or other similar material which permits high resolution printing and is attached to the skirt after removal of the locking ring and skirt from the forming mold. Molding of the skirt and locking ring prior to application of the end board permits a large locking ring to be formed while still providing the flexibility needed for removal of the integrally formed skirt and locking ring from the mold.

BRIEF DESCRIPTION OF THE DRAWINGS

In the accompanying drawings in which like reference numerals are used to indicate like parts in the various views.

DESCRIPTION OF THE PREFERRED EMBODIMENT

Figure 1:
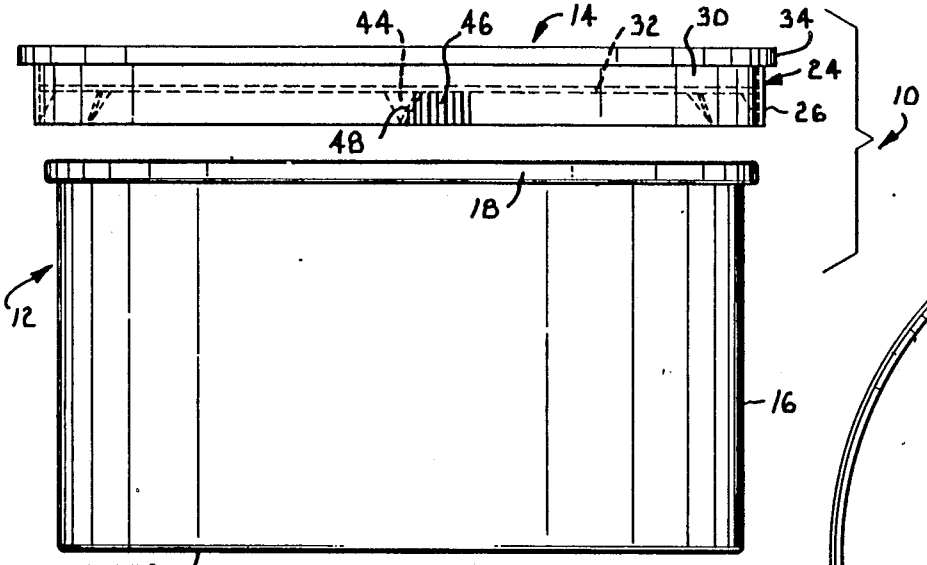
FIG. 1 is an exploded side elevational view of the tamper evident container assembly of the present invention.

Referring now to the drawings in greater detail, the numeral 10 broadly designates a tamper evident container assembly of the present invention. Container assembly 10 comprises a container 12 and a closure 14 which is applied to the container to seal the contents thereof. Closure 14 is adapted to provide a visual indication of initial opening of the container so that tampering of the container contents may be easily detached by visual inspection of the condition of the closure.

Container 12 comprises a cylindrical sidewall 16 which is rolled outwardly at a top rim to form a curled lip 18 which projects outwardly beyond the sidewall 16. The container has a bottom panel 20 but is open at the top. Paperboard or like materials are preferably used in the construction of the container but other materials may also be utilized if desired. While the container is illustrated as being of cylindrical configuration, it is to be understood that the container may also have other shapes if desired.

Closure 14 comprises a discoidal end board 22 which is coupled with a skirt 24 which extends downwardly along a peripheral edge of the end board. End board 22 is sized to cover the open top of container 12 and is preferably constructed of paperboard or similar materials which permits high resolution printing of product information and other graphics. Other materials may also be utilized if desired. A transparent window (not shown) may be provided in the end board to permit consumer viewing of the contents of the container 12. The window may be formed by cutting an opening in the end board 22 and covering the opening with a suitable transparent material.

Skirt 24 is preferably formed of injection molded plastic to provide the necessary strength and tamper evident indication. Many suitable types of thermoformable materials are known and may be utilized. Skirt 24 comprises a vertical wall 26 having an inner surface 28 which tightly engages the curled lip 18 of container 12 when the closure is applied to the container. The inner surface 28 of vertical wall 26 includes a circumferentially extending score line 32. As used herein, the term score line is intended to mean a weakened line of detachment formed in the vertical wall 26. The score line may be continuous or discontinuous and may extend partially or completely through the vertical wall. If desired, the score line 32 may extend inwardly from an outer surface 30 or the vertical wall rather than outwardly from the inner surface 28. Various mechanical and other types of well-known methods may be utilized to form the score line 32.

A vertical lip 34 is positioned outwardly from vertical wall 26 and is connected to a top edge of the vertical wall by a shoulder 36. A flange 38 extends inwardly from an inner surface of lip 34. It is preferred in the present invention to employ the use of a heat seal to completely seal the end board 22 to the skirt 24. A series of small rings or raised portions 40 extending upwardly from shoulder 36 and cooperating with flange 38 may be used to secure the discoidal end board to skirt 24. This may be particularly advantageous if sonics are used for sealing purposes, in which case the rings 40 would act as areas of concentration.

A locking ring 42 extends inwardly and upwardly from a bottom edge of the skirt 24. The locking ring is preferably integrally formed with the skirt and includes a series of spaced apart, V-shaped cutouts 44. The locking ring 42 is sized to extend upward to engage the undersurface of curled lip 18 to prevent upward movement and removal of the closure when it is applied to container 12.

A tear tab 46 is defined in skirt 24 by a scored line 48 which extends upwardly from the bottom edge of the skirt 24 to intersect the score line 32. The tear tab is positioned outwardly from a cutout 44 in locking ring 42 so that the lower end of the scored line intersects the cutout to facilitate initial tearing of the tab 46. The outer surface of the tear tab includes corrugated texturing to provide a visual indication of its location and to facilitate gripping of the tab.

The score line 32 divides the skirt into upper and lower segments which are approximately equal in vertical dimension. The upper segment of the skirt 24 has a vertical dimension sufficient to ensure that the lower edge of the skirt upper segment extends below the lip of the container after detachment of the locking ring 42 and the skirt lower segment. The vertical dimension of the skirt lower segment is preferably the same or greater than that of the skirt upper segment. This permits the angle between the locking ring 42 and the skirt 24 to be maintained at less than approximately 30 degrees so that initial removal of the closure is prevented while the locking ring remains attached to the skirt.

The closure 14 is preferably formed by molding the skirt 24 and locking ring 42 as an integral construction and then applying the paperboard or like end board 22 to the skirt after the skirt and locking ring have been removed from the forming mold. Various adhesives and other methods of attachment may be utilized. This two step construction allows the skirt and locking ring to retain the flexibility required for removal from the forming mold. If the end board 22 were integrally molded with the skirt and locking ring, the design of the mold would prevent removal of the components from the forming mold because of the large locking ring 42 provided by the present invention. Likewise, application of a paperboard end board to the skirt during the molding process or prior to removal of the skirt from the forming mold would frustrate removal of the components from the mold. Score line 32 may be formed either during or after the formation of skirt 24 and locking ring 42.

Figure 5:
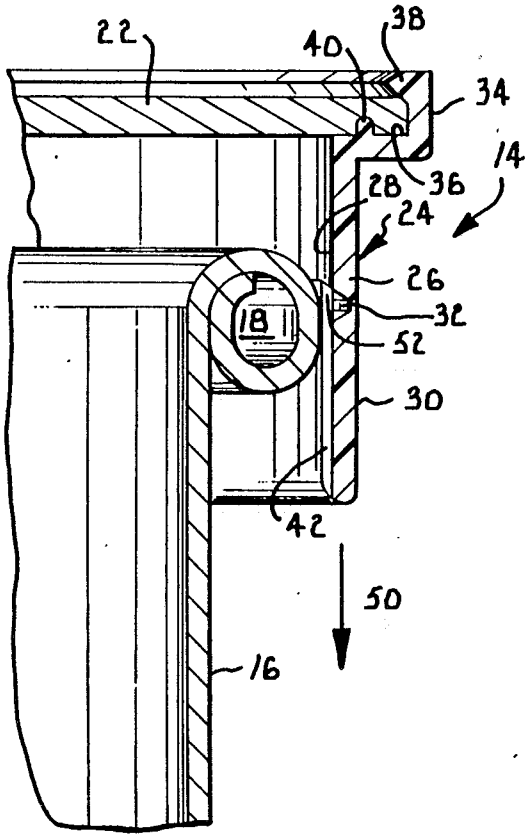
FIG. 5 is a fragmentary side elevational view of the container assembly showing the position of the locking ring as the closure is initially placed on to the container.
Figure 4:
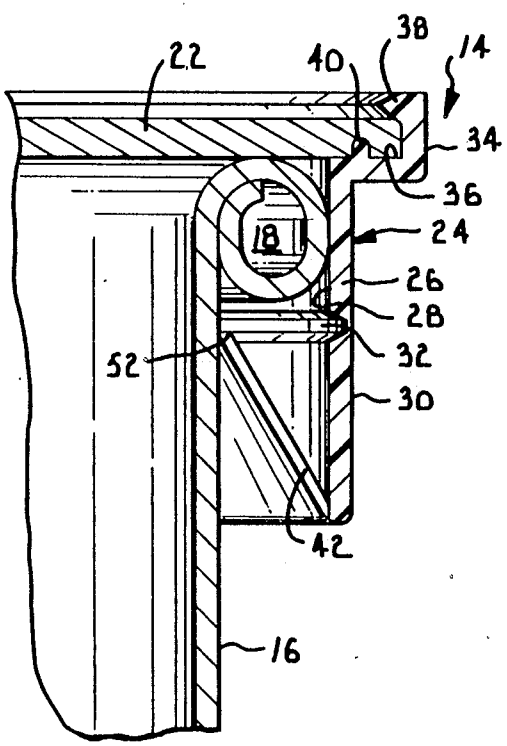
FIG. 4 is a fragmentary side elevational view of the container assembly taken along line 4—4 of FIG. 3.

As best seen in FIG. 5, closure 14 is initially applied to container 12 after the dairy product or other food product is inserted into the container. This is accomplished by applying a force to the closure 14 in a direction generally denoted by arrow 50 when the closure is placed over the open top of container 12. As the closure 14 is applied, the locking ring 42 is forced between the outwardly curled lip 18 of the container 12 and the inner surface 28 of the vertical wall 26. Further forcing the closure 14 in a direction 50 allows the upper end 52 of locking ring 42 to move downwardly beyond the lip 18 and flex substantially back to its molded state. As seen in FIG. 4, upper end 52 of locking ring 42 engages sidewall 16 of container 12 at a location just beneath the outwardly curled lip 18. The inner surface 28 of the vertical wall 26 tightly engages the container lip 18 to seal the container contents.

Figure 2:
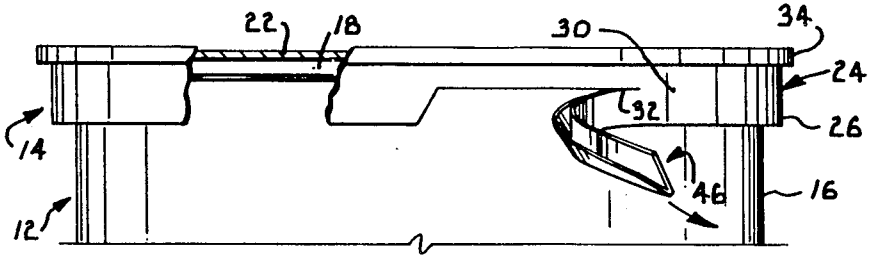
FIG. 2 is a side elevational view of the container assembly with portions broken away for purposes of illustration and with a tamper evident locking mechanism shown partially detached.
Figure 3:
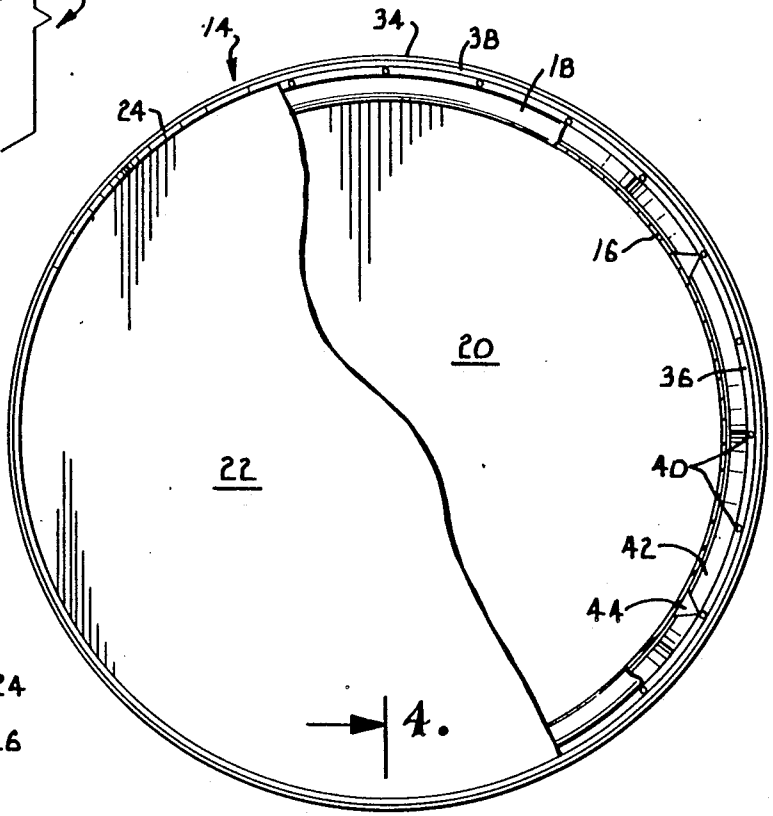
FIG. 3 is a top plan view of the tamper evident container assembly with portions broken away for illustration purposes.

Once the closure is applied to the container, removal of the closure is prevented while the locking ring 42 is still in place. As best illustrated in FIG. 2, to remove the locking ring when initially opening the container, the tear tab 46 is grasped and outward pressure is applied to initiate separation of the skirt lower segment and locking ring from the skirt upper segment. The detached skirt segment and locking ring may then be discarded after they have been completely detached from the remainder of the skirt.

Figure 6:
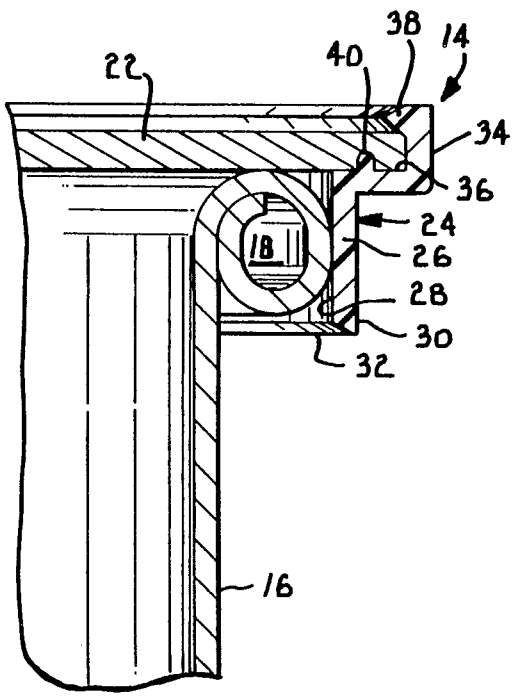
FIG. 6 is a fragmentary side elevational view of the container assembly but with the tamper evident locking mechanism removed.

As shown in FIG. 6, after removal of the skirt lower segment and locking ring, the upper segment of skirt 24 remains in engagement with the container lip 18 to maintain the closure in place on the container. The closure can be removed by simply applying an upward pressure on the remaining segment of the skirt. The closure may then be replaced on the container to reseal the contents by applying a downward force on the closure to seat the skirt segment against the container lip.

It can be seen that the tamper evident container assembly 10 provides a visual indication of tampering of the container contents. Initial opening of the closure 14 requires that the locking ring 42 be detached from the remainder of the closure. A missing or damaged locking ring thus serves to alert a consumer to the possibility that the container contents have been tampered with. Because of the high strength of the molded locking ring and skirt, the possibility of removal and replacement of the closure without damaging either the container or the closure is greatly reduced.

The method of manufacture of the closure 14 also permits the locking ring 42 to be sized for effective locking of the closure to the container. Application of the end board 22 to the closure after removal of the locking ring and skirt 24 from the forming mold allows the mold design to retain the flexibility required for its removal from the mold. If the end board were applied to the skirt prior to removal from the injection mold, the mold design would prevent removal of the closure from the mold core.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A closure lid for an open topped container having a rim presenting a lip at a top edge thereof, said closure lid comprising:

an end board sized for covering said open top of the container when applied thereto;

a skirt extending downwardly along a peripheral edge of said end board;

a raised portion extending upwardly from said skirt and mating with said end board to secure said end board to said skirt;

a locking ring extending inwardly and upwardly from a bottom edge of said skirt to engage the lip of the container to prevent removal of the closure lid when applied to the container; and a score line separating the skirt into upper and lower segments and located below the lowest edge of said container lip when said closure is engaging said container, said score line establishing a weakened line of detachment permitting separation of the skirt lower segment and attached locking ring from the skirt upper segment during initial removal of the closure lid from the container, whereby removal of the closure lid from the container requires detachment of the skirt lower segment and the locking ring.

2. The invention of claim 1, wherein said skirt and locking ring are integrally molded and said skirt upper segment has an inner wall surface for releasably engaging the container lip to permit replacement of the closure lid on the container after initial removal thereof.

3. The invention of claim 2, including means at a top edge of the skirt for attaching said end board to the skirt.

4. The invention of claim 3, wherein said means comprises an annular shoulder and an upright wall at an outer edge of said shoulder for engaging a peripheral edge of the end board.

5. The invention of claim 4, wherein said upright wall includes an inwardly projecting shoulder at a top edge thereof.

6. The invention of claim 2, including a tear tab in said skirt to facilitate separation of the skirt lower segment along the score line.

7. The invention of claim 6, wherein said tear tab is defined by a tear line extending from the skirt bottom edge and intersecting said score line.

8. The invention of claim 7, wherein said locking ring includes a cutout inwardly positioned from the tear line to permit finger access to the tear tab and to facilitate removal of the locking ring.

9. The invention of claim 1, wherein said raised portion is comprised of a plurality of projections extending upwardly from the skirt and mating with the end board to secure said end board to said skirt.

10. A container assembly for packaging of food items, said container assembly comprising:

an open topped container having a sidewall terminating in an outwardly rolled top rim;

an end board sized for covering said open top of the container;

a skirt extending downwardly along a peripheral edge of the end board;

a raised portion extending upwardly from said skirt and mating with said end board to secure said end board to said skirt;

a locking ring extending inwardly and upwardly from a bottom edge of the skirt and engaging the lip of the container to prevent removal of the closure when the locking ring is in place; and a score line separating the skirt into upper and lower segments and located below the lowest edge of said container lip when said closure is engaging said container, said score line establishing a weakened line of detachment permitting separation of the skirt lower segment and attached locking ring from the skirt upper segment during initial removal of the closure from the container, whereby removal of the closure from the container requires detachment of the skirt lower segment and the locking ring.

11. The invention of claim 10, wherein said skirt and locking ring are integrally molded and said skirt upper segment has an inner wall surface for releasably engaging the container lip to permit replacement of the closure on the container after initial removal thereof.

12. The invention of claim 11, including means at a top edge of the skirt for attaching said end board to the skirt.

13. The invention of claim 12, wherein said means comprises an annular shoulder and an upright wall at an outer edge of said shoulder for engaging a peripheral edge of the end board.

14. The invention of claim 13, wherein said upright wall includes an inwardly projecting shoulder at a top edge thereof.

15. The invention of claim 11, including a tear tab in said skirt to facilitate separation of the skirt lower segment along the score line.

16. The invention of claim 15, wherein said tear tab is defined by a tear line extending to the skirt bottom edge and intersecting said score line.

17. The invention of claim 16, wherein said locking ring includes a cutout inwardly positioned from the tear line to permit finger access to the tear tab and to facilitate removal of the locking ring.

18. The invention of claim 10, wherein said raised portion is comprised of a plurality of projections extending upwardly from the skirt and mating with the end board to secure said end board to said skirt.

* * * * *